US008752827B2

(12) United States Patent
Lee

(10) Patent No.: US 8,752,827 B2
(45) Date of Patent: Jun. 17, 2014

(54) MEDIUM STACKING APPARATUS AND FINANCIAL DEVICE COMPRISING THE SAME

(75) Inventor: Sumin Lee, Seoul (KR)

(73) Assignee: LG CNS Co., Ltd., Seoul (KR)

( * ) Notice: Subject to any disclaimer, the term of this patent is extended or adjusted under 35 U.S.C. 154(b) by 25 days.

(21) Appl. No.: 13/191,846

(22) Filed: Jul. 27, 2011

(65) Prior Publication Data

US 2012/0027554 A1 Feb. 2, 2012

(30) Foreign Application Priority Data

Jul. 29, 2010 (KR) ..... 10-2010-0073591

(51) Int. Cl.
*B65H 31/26* (2006.01)

(52) U.S. Cl.
USPC ..... 271/224; 271/207; 271/220

(58) Field of Classification Search
USPC ..... 271/207, 220, 223, 224
See application file for complete search history.

(56) References Cited

U.S. PATENT DOCUMENTS 2,761,682 A * 9/1956 Buccicone ..... 271/224
2,821,391 A * 1/1958 Buccicone ..... 271/224
2,904,335 A * 9/1959 Rabinow ..... 271/219
3,032,340 A * 5/1962 Lawrence ..... 271/182
3,358,993 A * 12/1967 Lytle ..... 271/224
3,907,128 A * 9/1975 Cathers ..... 414/788.9
3,977,669 A * 8/1976 Douno ..... 271/180
5,931,461 A * 8/1999 Xu ..... 271/224
6,073,926 A * 6/2000 Kaneda et al. ..... 271/221
6,354,588 B1 * 3/2002 Kuwahara et al. ..... 271/224
6,494,450 B2 * 12/2002 Tsurumaki ..... 271/224
7,029,008 B2 * 4/2006 Nishida et al. ..... 271/223
7,300,053 B2 * 11/2007 Asano ..... 271/224
7,380,784 B2 * 6/2008 Mizuno ..... 271/207
2012/0292849 A1 * 11/2012 Komatsu et al. ..... 271/220

FOREIGN PATENT DOCUMENTS

KR 10-2009-0062327 A 6/2009

OTHER PUBLICATIONS

Notice of Allowance dated Sep. 24, 2011 in Korean Application No. 10-2010-0073591, filed Jul. 29, 2010.

* cited by examiner

*Primary Examiner* — Ernesto Suarez
(74) *Attorney, Agent, or Firm* — Saliwanchik, Lloyd & Eisenschenk

(57) ABSTRACT

Provided is a medium stacking apparatus, which comprises a stacking frame and a damper. The stacking frame forms a stacking space in which media are stacked, and comprises a medium inlet. The damper collides with the medium introduced through the medium inlet, and absorbs a shock from the medium. The damper comprises one or more damping ribs that extend in a stacking direction of the media and are elastically deformed by a collision with the medium.

16 Claims, 6 Drawing Sheets

MEDIUM STACKING APPARATUS AND FINANCIAL DEVICE COMPRISING THE SAME

CROSS-REFERENCE TO RELATED APPLICATION

This application claims the benefit under 35 U.S.C. §119 of Korean Patent Application No. 10-2010-0073591, filed on Jul. 29, 2010, which is hereby incorporated by reference in its entirety.

BACKGROUND

Embodiments relate to a medium stacking apparatus and a financial device comprising the medium stacking apparatus.

Financial devices handle economically valuable media such as paper moneys. Financial devices may be installed in banks, public offices, and schools to handle various media. Herein, examples of a medium comprise a paper money, a check, a ticket, and a certificate, Such a financial device is provided with a medium stacking apparatus for aligning and stacking media. The medium stacking apparatus comprises a damping member to absorb a shock from a transferred medium colliding with a surface in a stacking space, thereby aligning and stacking media transferred one by one.+

However, although the damping member is disposed on the surface in the stacking space, when the length of a medium is smaller than the width of the stacking space, a moving distance of the medium is increased, and thus, a stacked state of media may be unstable.

BRIEF SUMMARY

Embodiments provide a medium stacking apparatus and a financial device comprising the medium stacking apparatus, in which the medium stacking apparatus comprises a damping structure for reliably stacking media regardless of sizes of the media.

In one embodiment, a medium stacking apparatus comprises: a stacking frame forming a stacking space in which media are stacked, and comprising a medium inlet; and a damper colliding with the medium introduced through the medium inlet, and absorbing a shock from the medium, wherein the damper comprises one or more damping ribs that extend in a stacking direction of the media and arc elastically deformed by a collision with the medium.

In another embodiment, a financial device comprises: a transfer passage through which media are transferred; and a medium stacking apparatus comprising a stacking space in which the media transferred along the transfer passage are stacked, wherein the medium stacking apparatus comprises: a transfer roller introducing the medium to the stacking space; a stacking guide in the stacking space, the medium being placed on the stacking guide; and a damper colliding with a front end of the medium introduced to the stacking space, wherein the damper comprises: a damper plate; and one or more damping ribs provided with the damper plate and elastically deformed to absorb a shock from the medium colliding with the damping ribs.

The details of one or more embodiments arc set forth in the accompanying drawings and the description below. Other features will be apparent from the description and drawings, and from the claims.

DETAILED DESCRIPTION

Figure 1:
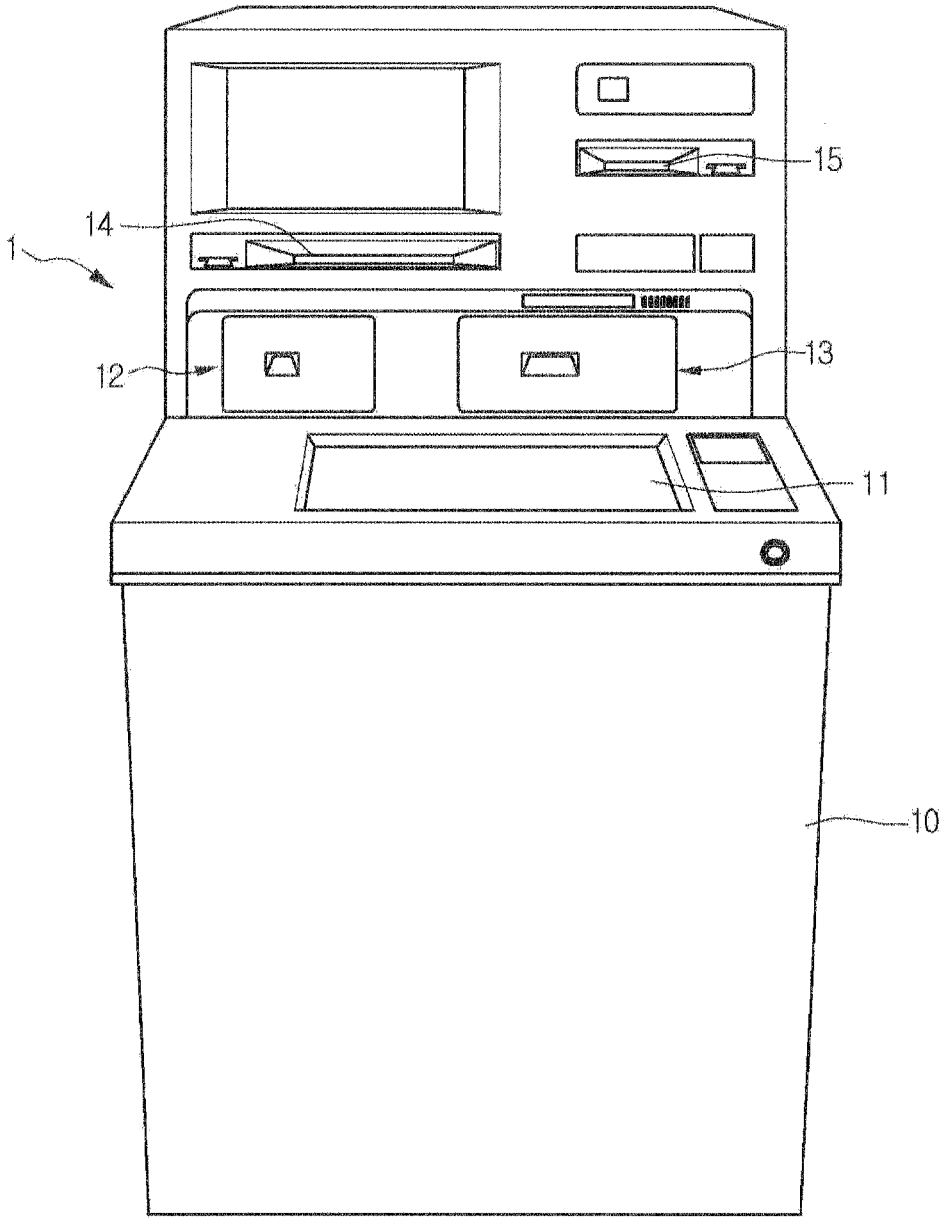
FIG. 1 is a perspective view illustrating a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing comprising processing such as deposit processing, giro receipt, or gift certificate exchange and/or processing such as withdrawal processing, giro dispensing, or gift certificate dispensing by receiving various medium such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

Figure 2:
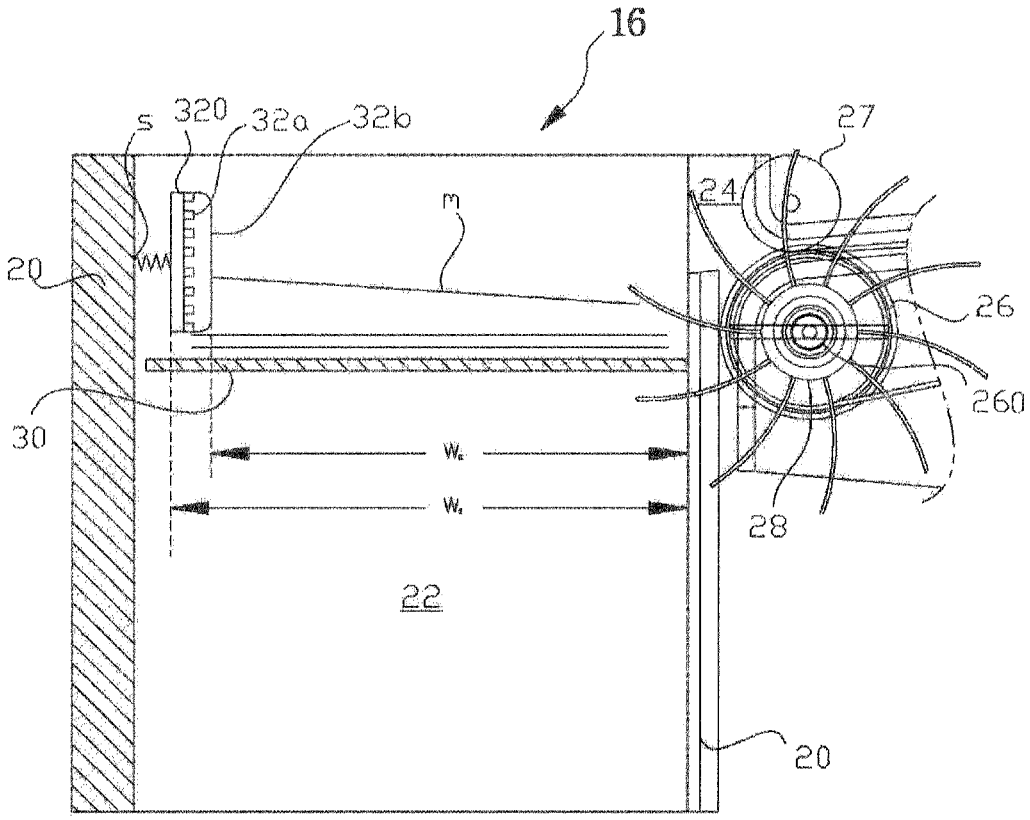
FIG. 2 is a schematic view illustrating a medium stacking apparatus according to an embodiment.

FIG. 1 is a perspective view illustrating a financial device according to an embodiment. FIG. 2 is a schematic view illustrating a medium stacking apparatus according to an embodiment.

Referring to FIGS. 1 and 2, a medium stacking apparatus 16 may be provided to, e.g., a financial device 1. However, the medium stacking apparatus 16 may be separately disposed in an area where media in is handled.

The financial device 1 comprises a main body 10 that receives the medium stacking apparatus 16 for stacking the media m therein. The main body 10 may comprise an input part 11 for a user to perform a financial process, a check entrance 12 through which a check is input and output, a paper money entrance 13 through which a paper money is input and output, a bankbook entrance 14 through which a bankbook is input and output, and a card entrance 15 through which a card is input and output. Since the financial device 1 may have a well-known structure, a description thereof will be omitted. At least one of the check entrance 12, the bankbook entrance 14, and the card entrance 15 may be removed. An entrance such as the check entrance 12 and the paper money entrance 13 through which the medium m is input and output may be referred to as a medium entrance. The media m input through the medium entrance are transferred along a transfer passage (not shown) in the financial device 1, and are stacked in the medium stacking apparatus 16.

A stacking frame 20 constitutes an appearance and a frame of the medium stacking apparatus 16. The medium stacking apparatus 16 is disposed in the financial device 1. The stacking frame 20 may be formed of a metal. A stacking space 22 in which the media m are stacked is disposed in the stacking frame 20.

The stacking frame 20 comprises a medium inlet 24. The medium m is input through the medium inlet 24. A transfer roller 26 is adjacent to the medium inlet 24, and is rotatable. The transfer roller 26 is provided to a rotation shaft 260 rotatable in the financial device 1. The transfer roller 26 is provided in plurality to be spaced a predetermined distance from each other on the rotation shaft 260. The transfer roller 26 introduces the medium m to the medium inlet 24. That is, the transfer roller 26 brings the medium m in close contact with an outer circumferential surface thereof to introduce the media m through the medium inlet 24 one by one.

Sheet rollers 28 are disposed on an outer circumferential surface of the rotation shaft 260. The sheet rollers 28 are disposed between the transfer rollers 26. The sheet rollers 28 may be disposed coaxially with the transfer rollers 26. The sheet rollers 28 are spaced a constant distance from each other in a spiral shape. The sheet rollers 28 are formed of a material such as rubber. The sheet rollers 28 hit the rear end of the medium m at a position where the medium m is discharged from the transfer roller 26, thereby aligning and placing the medium m in the stacking space 22. The sheet rollers 28 hit the rear end of the medium m such that the medium m collides with a damper 32 to be described later, and then, is aligned on a stacking guide 30.

The stacking guide 30 on which the medium m is placed is movable in the stacking space 22, and may have a plate shape. The stacking guide 30 moves in a direction according to the number of the media m stacked in the stacking space 22, so that the medium m can be close in contact with a surface of the stacking guide 30 and be uniformly aligned. The stacking guide 30 moves to the lower side of FIG. 2 to stack the media m.

The damper 32 is disposed on a side of the stacking space 22 to face the medium inlet 24. When the medium m is introduced, the front end of the medium m collides with the damper 32. The damper 32 may be formed of an elastic material, or be installed on the stacking frame 20 through an elastic member, thereby absorbing a shock generated when the medium m collides with the damper 32. For example, the damper 32 may be attached to a surface of the stacking frame 20 through an elastic member such as a spring S to absorb a shock applied to the damper 32 by the medium m.

Figure 3:
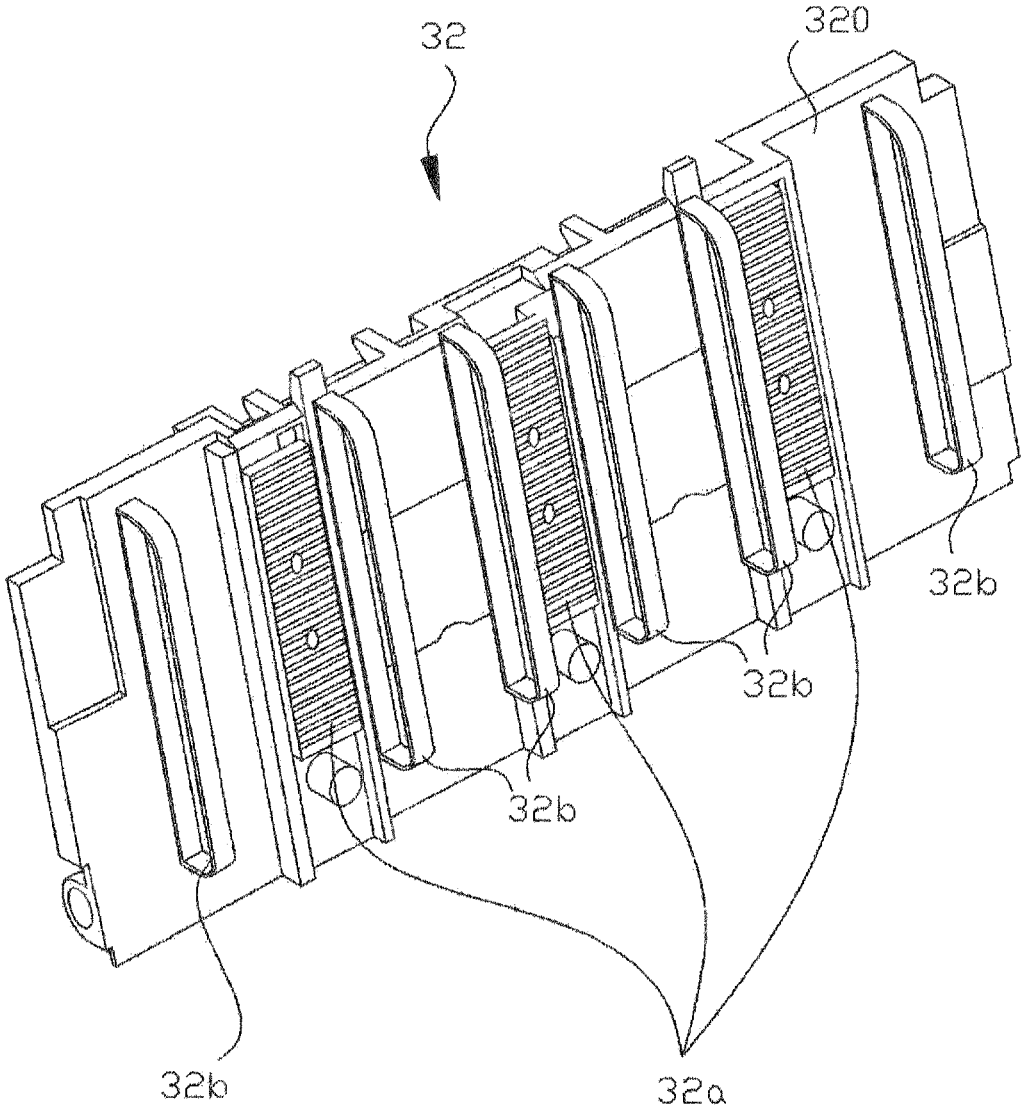
FIG. 3 is a perspective view illustrating a damping structure of a medium stacking apparatus according to an embodiment.
Figure 4:
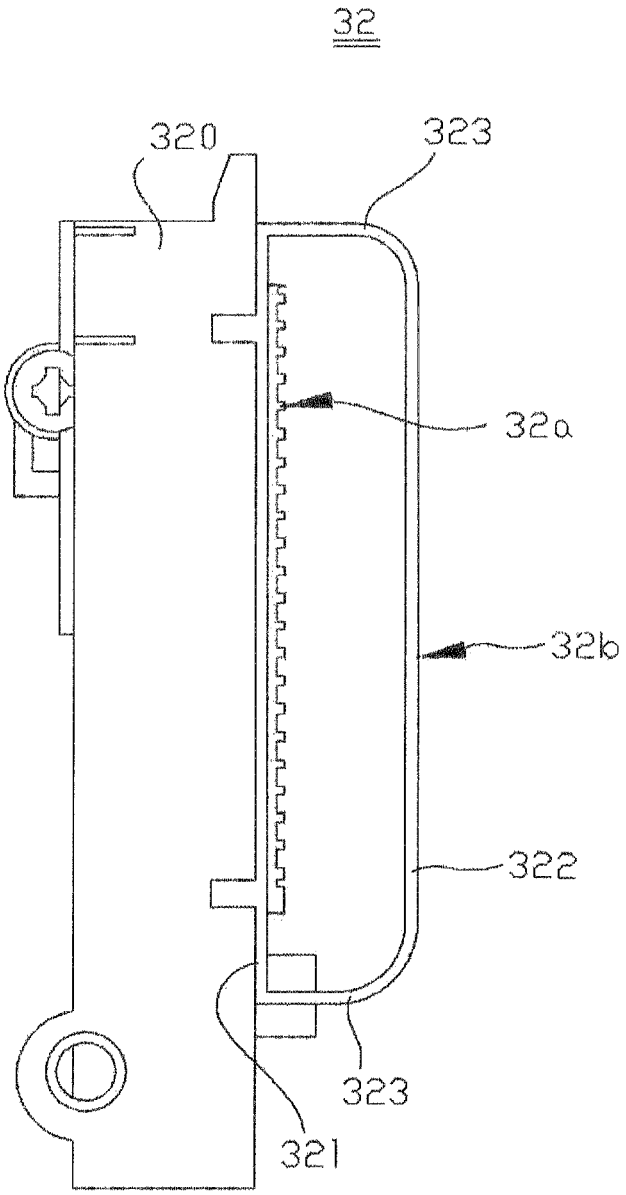
FIG. 4 is a side view illustrating a damping structure of a medium stacking apparatus according to an embodiment.
Figure 5:
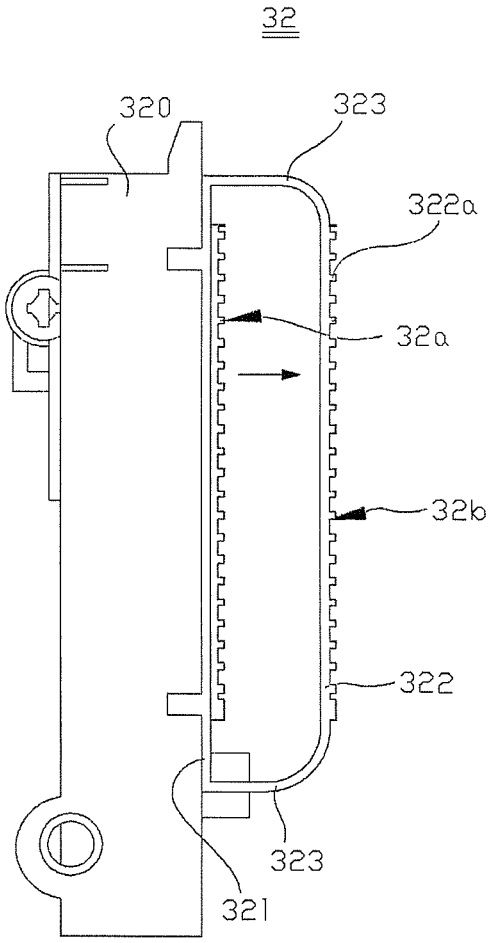
FIG. 5 is a side view illustrating a damping structure of a medium stacking apparatus according to an embodiment.

FIG. 3 is a perspective view illustrating a damping structure of a medium stacking apparatus according to an embodiment. FIG. 4 is a side view illustrating the damping structure of FIG. 3.

Referring to FIGS. 3 and 4, the damper 32 may comprise a damper plate 320 having a rectangular shape. For example, the damper plate 320 may be formed by molding a rectangular plate from a thermoplastic resin.

A surface of the damper plate 320 facing the medium inlet 24 is provided with guide protrusions 32*a* that are spaced a constant distance from each other. The guide protrusions 32*a* extend in a perpendicular direction to a stacking direction of the media m to guide the front end of the medium m when the medium m collides with the damper 32, and to prevent sliding and rotation of the medium m after the medium m collides with the damper 32.

After the front end of the medium m collides with the guide protrusion 32*a*, even when the medium m slides downward, an adjacent one of the guide protrusions 32*a* prevents the sliding, thereby preventing the front end of the medium m from excessively rotating.

Figure 6:
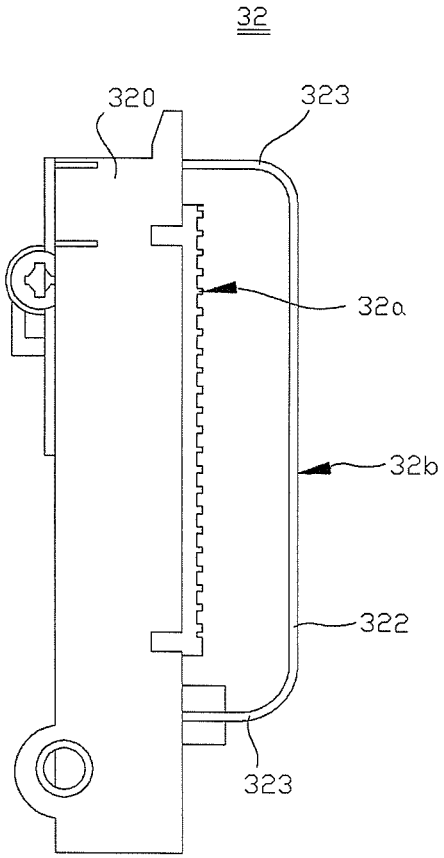
FIG. 6 is a side view illustrating a damping structure of a medium stacking apparatus according to an embodiment.

The surface of the damper plate 320 facing the medium inlet 24 is provided with one or more damping ribs 32*b*. Referring to FIG. 4, the damping rib 32*b* has an approximately rectangular ring shape. A side of the damping rib 32*b* is fixed to a surface of the damper plate 320, and another side thereof is spaced a predetermined distance from the damper plate 320 toward the medium inlet 24. That is, the damping rib 32*b* comprises a first rib 321 fixed to a surface of the damper plate 320, a plurality of connecting ribs 323 connected to the first rib 321 and vertically spaced apart from each other, and a second rib 322 connected to the connecting ribs 323 and spaced apart from the first rib 321. The medium m collides with the second rib 322. Alternatively, referring to FIG. 6 the connecting ribs 323 may be connected to the damper plate 320. The second rib 322 may be referred to as a collision rib. The damping rib 32*b* is fixed to the damper plate 320, and is elastically deformed when colliding with the medium m to absorb a shock from the medium m.

The length of the connecting rib 323 depends on the size of the media m to be stacked in the medium stacking apparatus 16. For example, when the media m have two different sizes, a length of the medium m that is longer in a transferring direction of the medium m may be a width W1 of the stacking space 22. A difference between the length W1 and a length W2 of the medium m that is shorter may be the length of the connecting rib 323.

Alternatively, the damper plate 320 or the guide protrusions 32*a* may be removed from the damper 32. That is, the damping rib 32*b* may be attached directly to the surface of the stacking frame 20 facing the medium inlet 24. That is, while the damper 32 comprises the damping rib 32*b*, the damper plate 320 and the guide protrusions 32*a* may be removed from the damper 32. For example, the damping rib 32*b* may be attached to the damper plate 320 without the guide protrusions 32*a*, or the guide protrusions 32*a* and the damping rib 32*b* may be attached directly to the surface of the stacking frame 20 facing the medium inlet 32.

The damping rib 32*b* may be formed of a flexible elastic material such as rubber to absorb a shock and restore its original shape. The hardness of the damping rib 32*b* may be sufficiently decreased such that the medium m reaches the damper plate 320 after colliding with the damping rib 32*b*. For example, the damping rib 32*b* may be formed of a plastic material. In this case, the damping rib 32*b* may have a thickness to be elastically deformed by a collision with the medium m. A material used to form the damping rib 32*b* is not limited to the above-described materials.

Referring to FIG. 4, the damping rib 32*b* extends in the stacking direction of the media m, and may be provided in plurality according to a colliding width of the medium m with the damper 32. A surface of the damping rib 32*b* colliding with the medium m may be provided with protrusions 322*a* that extend in the perpendicular direction to the stacking direction of the media m to prevent downward sliding of the medium m.

Referring to FIG. 2, even when the medium m has a smaller length than the width W1 of the stacking space 22, the medium m reaches at least the damping rib 32*b*. Thus, the medium m can collide with the damping rib 32*b*, and the rear end of the medium m can be disposed within a rotation range of the sheet rollers 28. That is, even when the medium m has a smaller length than the width W1 of the stacking space 22, the medium m collides with the damping rib 32*b* after being discharged from the transfer roller 26, and a velocity of the medium m is decreased. Thus, the rear end of the medium m can be hit downward by the sheet rollers 28.

On the contrary, when the medium m has a length equal to the width W1 of the stacking space 22, the medium m is sufficiently long, and receives driving force from the transfer roller 26 for a longer period of time. Thus, even after colliding with the damping rib 32*b*, the medium in further moves and reaches the damper plate 320, and then, is placed on the stacking guide 30. That is, the collision rib 322 receives force in a moving direction of the medium m, and is elastically deformed to absorb a shock from the medium m, and the medium m further move in the moving direction even after colliding with the collision rib 322. After reaching the damper plate 320, the rear end of the medium m is hit by the sheet rollers 28 and is placed on the stacking guide 30.

An operation of a medium stacking apparatus configured as described above and an operation of a financial device comprising the medium stacking apparatus will now be described.

The medium m is brought in close contact with the transfer rollers 26, and is introduced to the medium inlet 24. When the medium m is discharged from the transfer rollers 26, the medium m is disposed in the stacking space 22. Then, the front end of the medium m collides with the damper 32. When the medium m has a smaller length than the width W1 of the stacking space 22, the damping rib 32*b* absorbs a shock from the medium m, and the sheet rollers 28 hit the rear end of the medium m downward.

When the medium m has a length equal to the width W1 of the stacking space 22, the medium m collides with the damping rib 32*b*, and then further moves to collide with the guide protrusions 32*a* of the damper plate 320. Then, the sheet rollers 28 hit the rear end of the medium m toward the stacking guide 30.

At this point, the rear end of the medium m is inclined downward, and the medium m is placed on the stacking guide 30. As a result, the placing of one of the media m to be stacked is completed.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or comprise or has) only those elements, or it may comprise (or comprise or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A medium stacking apparatus comprising:

a stacking frame forming a stacking space in which media are stacked, and comprising a medium inlet; and a damper colliding with the medium introduced through the medium inlet, and absorbing a shock from the medium, wherein the damper comprises one or more damping ribs that extend in a stacking direction of the media and are elastically deformed by a collision with the medium, a damper plate provided at a rear side of the one or more damping ribs to support the one or more damping ribs, and a plurality of guide protrusions disposed on a surface of the damper plate, wherein the damper plate facing the medium inlet is elastically attached to a surface of the stacking frame by an elastic spring, wherein each of the one or more damping ribs comprises a first rib fixed to the damper plate, a plurality of connecting ribs connected to the first rib and vertically spaced apart from each other, and a second rib connected to the connecting ribs, wherein the plurality of guide protrusions are disposed vertically spaced apart from each other such that the medium is inhibited from downward sliding, and wherein the first rib, the plurality of connecting ribs and the second rib are integrally formed with each other.

2. The medium stacking apparatus of claim 1, wherein the one or more damping ribs are spaced apart from a surface of the stacking frame facing the medium inlet.

3. The medium stacking apparatus of claim 1:

wherein the one or more damping ribs are disposed on the surface of the damper plate facing the medium inlet.

4. The medium stacking apparatus of claim 1, wherein the one or more damping ribs are formed of an elastic material.

5. The medium stacking apparatus of claim 1, wherein the media introduced to the stacking space have two different lengths, and the plurality of connecting ribs has a length corresponding to a difference between the lengths.

6. The medium stacking apparatus of claim 1, wherein a length of each of the plurality of connecting ribs is longer than a protrusion length of each of the plurality of guide protrusions.

7. The medium stacking apparatus of claim 1, wherein the first rib, the second rib and the plurality of connecting ribs define an opening, and the second rib can be deformed by the opening when colliding with the medium.

8. The medium stacking apparatus of claim 1, wherein each connecting rib is extended from the first rib perpendicularly.

9. A financial device comprising:

a transfer passage through which media are transferred; and a medium stacking apparatus comprising a stacking space in which the media transferred along the transfer passage are stacked, wherein the medium stacking apparatus comprises:

a transfer roller introducing the medium to the stacking space;

a stacking guide in the stacking space, the medium being placed on the stacking guide; and a damper colliding with a front end of the medium introduced to the stacking space, wherein the damper comprises:

a damper plate;

an elastic spring configured to elastically support the damper plate;

one or more damping ribs provided on a first surface of the damper plate and elastically deformed to absorb a shock from the medium colliding with the one or more damping ribs, the damper plate being provided at a rear side of the one or more damping ribs; and a plurality of guide protrusions provided on the first surface of the damper plate, and disposed vertically spaced apart from each other such that the medium is inhibited from downward sliding, wherein each of the one or more damping ribs comprises a first rib fixed to the first surface of the damper plate, a plurality of connecting ribs connected to the first rib and vertically spaced apart from each other, and a second rib connected to the connecting ribs, and wherein the first rib, the plurality of connecting ribs and the second rib are integrally formed with each other.

10. The financial device of claim 9, wherein the media stacked in the stacking space have different lengths, and a distance between a side of the damping rib and the damper plate corresponds to a difference between the lengths.

11. The financial device of claim 9, further comprising a sheet roller provided to the damper plate, wherein, when a medium having a length smaller than a width of the stacking space is introduced to the stacking space, the one or more damping ribs absorb a shock from the medium, and the sheet roller is configured to hit a rear end of the medium, and wherein when a medium having a length corresponding to the width of the stacking space is introduced to the stacking space, the one or more damping ribs are configured to collide with the medium, and at least one of the plurality of guide protrusions is configured to collide with the medium, and the sheet roller is configured to hit a rear end of the medium.

12. The financial device of claim 9, wherein the first rib, the second rib and the plurality of connecting ribs define an opening, and the second rib can be deformed by the opening when colliding with the medium.

13. The financial device of claim 9, wherein each connecting rib is extended from the first rib perpendicularly.

14. A medium stacking apparatus comprising:

a stacking frame forming a stacking space in which media are stacked, and comprising a medium inlet; and a damper colliding with the medium introduced through the medium inlet, and absorbing a shock from the medium, wherein the damper comprises a damper plate, an elastic spring configured to elastically support the damper plate, one or more damping ribs that extend in a stacking direction of the media and are elastically deformed by a collision with the medium, the damper plate being provided at a rear side of the one or more damping ribs, and a plurality of guide protrusions disposed on a surface of the damper plate, wherein each of the one or more damping ribs comprises:

a plurality of connecting ribs fixed to the damper plate and vertically spaced apart from each other, and a collision rib connected to the connecting ribs, wherein the plurality of guide protrusions are disposed vertically spaced apart from each other such that the medium is inhibited from downward sliding, and the plurality of connecting ribs and the collision rib are integrally formed with each other.

15. The medium stacking apparatus of claim 14, wherein the collision rib and the plurality of connecting ribs define an opening, the collision rib can be deformed by the opening when colliding with the medium.

16. The medium stacking apparatus of claim 14, wherein each connecting rib is extended from the damper plate perpendicularly.

* * * * *